US006889754B2

(12) United States Patent
Kroliczek et al.

(10) Patent No.: US 6,889,754 B2
(45) Date of Patent: May 10, 2005

(54) PHASE CONTROL IN THE CAPILLARY EVAPORATORS

(75) Inventors: Edward J. Kroliczek, Davidsonville, MD (US); David A. Wolf, Sr., Baltimore, MD (US); James Seokgeun Yun, Silver Spring, MD (US)

(73) Assignee: Swales & Associates, Inc., Beltsville, MD (US)

( * ) Notice: Subject to any disclaimer, the term of this patent is extended or adjusted under 35 U.S.C. 154(b) by 249 days.

(21) Appl. No.: 09/896,561

(22) Filed: Jun. 29, 2001

(65) Prior Publication Data

US 2002/0007937 A1 Jan. 24, 2002

Related U.S. Application Data

(60) Provisional application No. 60/215,588, filed on Jun. 30, 2000.

(51) Int. Cl.[7] ..... F28D 15/00

(52) U.S. Cl. ..... 165/104.26; 165/104.21; 165/104.19; 165/104.11

(58) Field of Search ..... 165/104.26, 104.21, 165/104.19, 104.11, 104.25, 104.24, 104.23, 104.27, 104.32, 46 P, 415, 274

(56) References Cited

U.S. PATENT DOCUMENTS

| | | | | |
|---|---|---|---|---|
| 4,862,708 A | * | 9/1989 | Basiulis | 62/502 |
| 5,103,897 A | * | 4/1992 | Cullimore et al. | 165/274 |
| 5,303,768 A | * | 4/1994 | Alario et al. | 165/104.26 |
| 5,771,967 A | | 6/1998 | Hyman | |
| 5,816,313 A | * | 10/1998 | Baker | 165/41 |
| 5,842,513 A | * | 12/1998 | Maciaszek et al. | 165/104.26 |
| 5,944,092 A | * | 8/1999 | Van Oost | 165/104.26 |
| 5,950,710 A | * | 9/1999 | Liu | 165/41 |
| 6,058,711 A | * | 5/2000 | Maciaszek et al. | 62/3.2 |
| 6,382,309 B1 | | 5/2002 | Kroliczek et al. | |
| 6,615,912 B2 | * | 9/2003 | Garner | 165/104.26 |

FOREIGN PATENT DOCUMENTS

| | | |
|---|---|---|
| EP | 0 210 337 | 2/1987 |
| EP | 0 987 509 | 3/2000 |
| RU | 2 098 733 | 3/1995 |
| SU | 1 467 354 | 1/1987 |
| WO | 02/10661 A1 | 2/2003 |

OTHER PUBLICATIONS

W. Bienert et al., "The Proof–Of–Feasibility of Multiple Evaporator Loop Heat Pipe", 6$^{th}$ European Symposium on Environmental systems, May 1997, 6 pages.

S. Yun et al., "Design and Test Results of Multi–Evaporator Loop Heat Pipe", SAE Paper No. 1999–01–2051, 29$^{th}$ International Conference on Environmental systems, Jul. 1999, 7 pages.

(Continued)

*Primary Examiner*—Nihir Patel
(74) *Attorney, Agent, or Firm*—Fish & Richardson P.C.

(57) ABSTRACT

A capillary pump two phase heat transport system that combines the most favorable characteristics of a capillary pump loop (CPL) with the robustness and reliability of a loop heat pipe (LHP). Like a CPL, the hybrid loop has plural parallel evaporators, plural parallel condensers, and a back pressure flow regulator. Unlike CPLs, however, the hybrid system incorporates elements that form a secondary loop, which is essentially a LHP that is co-joined with a CPL to form an inseparable whole. Although secondary to the basic thermal management of the system thermal bus, the LHP secondary loop portion of the system provides for important operational functions that maintain healthy, robust and reliable operation. The LHP secondary loop portion provides a function of fluid management during start-up, steady state operation, and heat sink/heat source temperature and power cycling.

34 Claims, 10 Drawing Sheets

OTHER PUBLICATIONS

Van Oost et al., "Test Results of Reliable and Very High Capillary Multi–Evaporator/Condenser Loop", 25$^{th}$ International Conference on Environmental Systems, Jul. 10–13, 1995, 12 pages.

Kotlyarov et al., "Methods of Increase of the Evaporators Reliability for Loop Heat Pipes and Capillary Pumped Loop", 24$^{th}$ International Conference on Environmental systems, Jun. 20–23, 1994, 15 pages.

Hoang, "Advanced Capillary Pumped Loop (A–CPL) Project Summary" Contract No.: NAS55–98103, Mar. 1994, pp. 1–37.

Jentung Ku, Operational Characteristics of Loop Heat Pipes, NASA Goddard Space Flight Center; SAE Paper 99–01–2007, 29 International Conference on Environmental Systems, Denver, Colorado, Jul. 12–15, 1999; Society of Automotive Engineers, Inc.

A methodology for enveloping reliable start–up of LHPs, AIAA Paper 2000–2285 (AIAA Accession No. 33681) Jane Baumann, Brent Cullimore (Cullimore and Ring Technologies, Littleton, CO), Jay Ambrose, Eva Buchan, and Boris Yendler (Lockheed Martin Corp., Sunnyvale, CA), AIAA Thermophysics Conference, 34th, Denver, CO, Jun. 19–22, 2000.

* cited by examiner

PHASE CONTROL IN THE CAPILLARY EVAPORATORS

CROSS REFERENCE TO RELATED APPLICATION

This application claims priority under 35 U.S.C. §119(e) from provisional application no. 60/215,588, filed Jun. 30, 2000. The Ser. No. 60/215,588 application is incorporated by reference herein, in its entirety, for all purposes.

INTRODUCTION

The present invention relates generally to the field of heat transport. More particularly, the present invention relates to loop heat pipes having plural capillary evaporator structures wherein phase of the working fluid is controlled to maintain system stability.

BACKGROUND OF THE INVENTION

Loop Heat pipes (LHPs) and Capillary Pumped Loops (CPLs) are passive two-phase heat transport systems that utilize the capillary pressure developed in a fine pored evaporator wick to circulate the system's working fluid. CPLs, which were developed in the United States, typically feature one or more capillary pumps or evaporators, while LHPs, which originated in the former Soviet Union, are predominantly single evaporator systems. The primary distinguishing characteristic between the two systems is the location of the loop's reservoir, which is used to store excess fluid displaced from the loop during operation. A reservoir of a CPL is located remotely from the evaporator and is cold biased using either the sink or the subcooled condensate return. On the other hand, the reservoir of an LHP is thermally and hydraulically coupled to the evaporator. This difference in reservoir location is responsible for the primary difference in the behavior of the two devices.

Referring to FIG. 1, the separation of the reservoir 110 from the plural, parallel evaporators 120 in a CPL is schematically illustrated. This separation makes it possible to construct thermal management loops that can incorporate any combination of series connected or parallel connected evaporators 120 and/or condensers 130.

This feature offers distinct advantages for applications that require heat dissipation from large payload footprints or multiple separated heat sources. CPL's have also demonstrated highly desirable thermal control/management properties such as sensitive temperature control properties that require only very modest application of heat to its reservoir, highly effective heat load sharing between evaporators that can totally eliminate the need for any heater energy to maintain inactive equipment at safe-mode temperatures, and heat sink (condenser) diode action which can provide protection from temporary exposure to hot environments.

Unfortunately, the advantages derived from a separated (remotely located) reservoir result in significant disadvantages that have limited the further evolution and application of CPL's. For example, CPL's are disadvantaged during start-up because the loop must first be preconditioned by heating the reservoir to prime the evaporator's wick before the heat source can be cooled. The principle disadvantage of CPL's, however, is its total reliance on subcooled liquid return to maintain stable operation at each and every evaporator capillary pump. As a consequence, CPL's require low conductivity wick materials to minimize their reliance on subcooling and impose constraints on tolerable system power and/or environment temperature cycling conditions.

On the other hand, referring to FIG. 2, a reservoir 210 of a LHP is co-located with the evaporator 220 and is thermally and hydraulically coupled to it with a conduit 230 that contains a capillary link 234 often referred to as a secondary wick. The interconnecting conduit 230 makes it possible to vent any vapor and/or bubbles of non-condensible gas (or "NCG bubbles") from the core of the evaporator 220 to the reservoir 210. The capillary link 234, on the other hand, makes it possible to pump liquid from the reservoir 210 to the evaporator 220. This insures a wetted primary wick 224 during start-up, and prevents liquid depletion of the primary wick 224 during normal steady state operation and during transient temperature conditions of either the heat source 240 or the heat sink 250 (adjacent the condenser 260). This architecture makes LHP's extremely robust and reliable, and makes preconditioning during start-up unnecessary. The control of vapor and liquid in the pump core provided by the secondary wick 234 minimizes the reliance of the loop on liquid subcooling. As a result, LHP's utilize metallic wicks, which offer an order of magnitude improvement in pumping capacity over the low conductivity wicks that are typically used in CPL's.

The problem with "robust" LHP's is that they are limited to single evaporator/reservoir designs, which limit their application to heat sources with relatively small thermal footprints.

Ideally, a true thermal bus should incorporate the unrestricted combination of multiple evaporators and thermal management properties of a CPL together with the reliability and robustness of an LHP. One impediment to even greater utilization of the LHP is its limitation to single evaporator systems. Many applications require thermal control of large payload footprints or multiple separated heat sources that are best served by multiple evaporator LHP's, which ideally would offer the same reliability and robustness as their single evaporator predecessors.

Several investigators have previously experimented with multiple evaporator LHP's with mixed results. The effort of these investigators, summarized below, indicates that multiple evaporator LHP's are only marginally feasible. These multiple evaporator LHP's are limited in the number of evaporators that can be plumbed in parallel and/or are limited in the spatial separation between the evaporators.

Bienert et al. developed a breadboard LHP with two evaporators, each with its own compensation chamber (reservoir). Although the loop, which was charged with water, was designed without rigorous sizing and seemed to be sensitive to non-condensible gas, the breadboard made a proof-of-principle demonstration of the feasibility of a dual evaporator LHP. For further details, refer to Bienert, W., Wolf, D., and Nikitkin, M., "The Proof-Of-Feasibility Of Multiple Evaporator Loop Heat Pipe", $6^{th}$ European Symposium on Environmental Systems, May 1997.

More recently, the inventors of the present invention developed and demonstrated reliable operation of a dual evaporator LHP system, with a separate reservoir to each evaporator pump, was using ammonia as working fluid. Referring to FIG. 3, a schematic view of this dual evaporator LHP is illustrated. It has two parallel evaporator pumps 310, 320, each with its own reservoir 312, 322, vapor transport lines 314, 324, and liquid transport lines 316, 326, and a direct condensation condenser 330. The reservoirs 312, 322 were sized and the system charged to allow one reservoir to completely fill with liquid while the other reservoir remained partially filled at all operating conditions. The dual evaporator/dual reservoir design clearly demonstrated comparable reliability and robustness as its single evaporator predecessors. For further details, refer to Yun, S., Wolf, D., and Kroliczek, E., "Design and Test Results of Multi-Evaporator Loop Heat Pipe", SAE Paper No. 1999-01-2051, $29^{th}$ International Conference on Environmental Systems, July 1999.

However, there is limitation on the number of evaporators that can be reasonably used in multiple reservoir systems that are designed to operate over a wide temperature range. Referring to FIG. 4, a graphical analysis of hydro-accumulator sizing is illustrated for a typical LHP system designed for a maximum operating temperature of 65° C. As the minimum operating temperature decreases, and the hydro-accumulator volume increases rapidly as the number of evaporators increases. As an example, at a minimum operating temperature of −40° C., the volume of each hydro-accumulator increases by a factor of three between a two-evaporator system and a three-evaporator system. Over the same operating temperature range, a four-evaporator system would require an infinite hydro-accumulator volume.

Van Oost et al. developed a High Performance Capillary Pumping Loop (HPCPL) that included three parallel evaporators connected to the same reservoir. Referring to FIG. 5, a schematic view of the basic design of the HPCPL loop is illustrated. The reservoir 510 was co-located at the evaporator end of the loop, and included capillary links 512, 514 between the evaporators 522, 524 and the reservoir 510, making the device similar to a LHP. The loop has been successfully tested on the ground with a favorable gravitational bias of the evaporators relative to the reservoir. This orientation constraint is due to limits imposed by the capillary links 512, 514. For further details, refer to Van Oost et al., "Test Results of Reliable and Very High Capillary Multi-Evaporator/Condenser Loop", $25^{th}$ International Conference on Environmental Systems, Jul. 10–13, 1995.

Although this concept represents some advantages over a single evaporator LHP design, the capillary link 512, 514 connecting the evaporators 522, 524 to the reservoir 510 limits the separation between the evaporators and the reservoir. This limitation is similar to the transport and orientation limitations normally encountered with conventional heat pipes, as described by Kotlyarov et al., "Methods of Increase of the Evaporators Reliability for Loop Heat Pipes and Capillary Pumped Loop", $24^{th}$ International Conference on Environmental Systems, Jun. 20–23, 1994.

The robustness of an LHP is derived from its ability to purge vapor/NCG bubbles via a path 516, 518 from the liquid core of the evaporator 522, 524 to the reservoir 510. The disadvantage of the LHP is the limitation imposed by the heat pipe like characteristics of the capillary link. Hoang suggested (in a document entitled "Advanced Capillary Pumped Loop (A-CPL) Project Summary", Contract No. NAS5-98103, March 1994) that such a link could itself be a loop and incorporated the idea in an Advanced Capillary Pumped Loop (A-CPL) concept which incorporates both the advantages of a robust LHP and the architectural flexibility of a CPL. An A-CPL system has been successfully co-developed and demonstrated by TTH Research, Inc. and Swales Aerospace.

Referring to FIG. 6, a schematic view of the A-CPL concept is illustrated. The ACPL contains two conjoint independently operated loops—a main loop and an auxiliary loop. The main loop is basically a traditional CPL whose function is to transport the waste heat $Q_V$ input at the evaporator capillary pump 610 and reject it to a heat sink via the primary condenser 620. Hence, hardware and operational principles of the main loop are similar to those of a CPL. The auxiliary loop is utilized to remove vapor/NCG bubbles from the core of the evaporator capillary pump 610 and the reservoir capillary pump 630 and move them to the two-phase reservoir 640. The auxiliary loop also provides $Q_R$ heat transport from the reservoir capillary pump 630 to heat sinks via the auxiliary condenser 650 and the primary condenser 620. In addition, the auxiliary loop is also employed to facilitate the start-up process. In this manner, the auxiliary loop functionally replaces the secondary wick in a conventional LHP.

An A-CPL prototype was fabricated and tested with the goal of demonstrating the basic feasibility of the concept. Referring to FIG. 7, a schematic view of the prototype loop is illustrated. The A-CPL prototype consisted of two 3-port nickel CPL evaporator pumps 710, 720 with a secondary loop driven by a reservoir capillary pump 730. For this prototype, the reservoir capillary pump 730 was a "short" evaporator loop heat pipe (LHP), whose hydro-accumulator 732 also serves as the entire system's reservoir. The LHP was used as the reservoir capillary pump 730 only to verify the functionality of the secondary loop. In its final form, the A-CPL would be equipped with an reservoir capillary pump that is optimized for its specific function. Testing demonstrated the feasibility of:

- Operation of multiple, small diameter (<1" OD) metal nickel wick
- Startup without pressure priming and liquid clearing of vapor line. (typical CPL startup process)
- Quick startup
- Robust operation under severe operational conditions (low power, power cycling, condenser cycling)

However, the above demonstration was achieved in series connected evaporator configuration only. This means that the secondary flow created by the reservoir capillary pump 730 flowed through the liquid cores of the evaporator pumps 710, 720 in series. Several tests were also conducted in parallel configuration. Results showed that the secondary flow preferentially went to the #1 evaporator pump 710, which has slightly less impedance in its liquid inlet line section than the #2 evaporator pump 720. This bias toward the #1 evaporator pump 710 made testing in a parallel configuration difficult to characterize.

SUMMARY OF THE INVENTION

It is an object of the present invention to provide a hybrid capillary pump loop (or "HCPL") arrangement that combines the thermal management features of a CPL with the robust and reliable operation of a LHP.

It is another object of the present invention to provide a capillary evaporator for use in an HCPL arrangement that combines the thermal management features of a CPL with the robust and reliable operation of a LHP.

It is yet another object of the present invention to provide a capillary evaporator that has a secondary liquid flow channel and a secondary vapor flow channel in addition to the primary liquid return line and the primary vapor exit line.

It is still another object of the present invention to provide a back pressure regulator for use in an HCPL arrangement that combines the thermal management features of a CPL with the robust and reliable operation of a LHP.

An HCPL system according to an embodiment of the present invention is a capillary pump two phase heat transport system that combines the most favorable characteristics of a CPL with the robustness and reliability of an LHP. Like a CPL, the HCPL consists of the following elements:

- Multiple parallel evaporators that make it possible to accommodate multiple independent heat sources
- Multiple parallel condensers that include capillary flow regulators to insure full utilization of the condenser independently of pressure drop and/or heat sink temperature variations
- Back pressure flow regulator(s) that allow(s) heat to be shared between evaporators Unlike CPLs, however, an HCPL according to an embodiment of the present invention incorporates elements that form a secondary loop. That secondary loop is essentially a LHP that is co-joined with the CPL to form an inseparable whole. Although secondary to the basic thermal management of the HCPL thermal bus, the LHP loop portion of the system provides for the most essential operational functions that maintain healthy, robust and reliable operation. The function provided by the LHP is one of fluid management during start-up, steady state operation and heat sink/heat source temperature and power cycling.

Systems embodied according to the present invention accrue passive thermal management properties that include:

- robust and reliable performance characteristics during start-up
- robust and reliable performance characteristics during steady state operation
- robust and reliable performance characteristics during cycling of temperature and power at the heat sinks and the heat sources Additional objects and advantages of the present invention will be apparent in the following detailed description read in conjunction with the accompanying drawing figures.

DETAILED DESCRIPTION OF THE INVENTION

Figure 1:
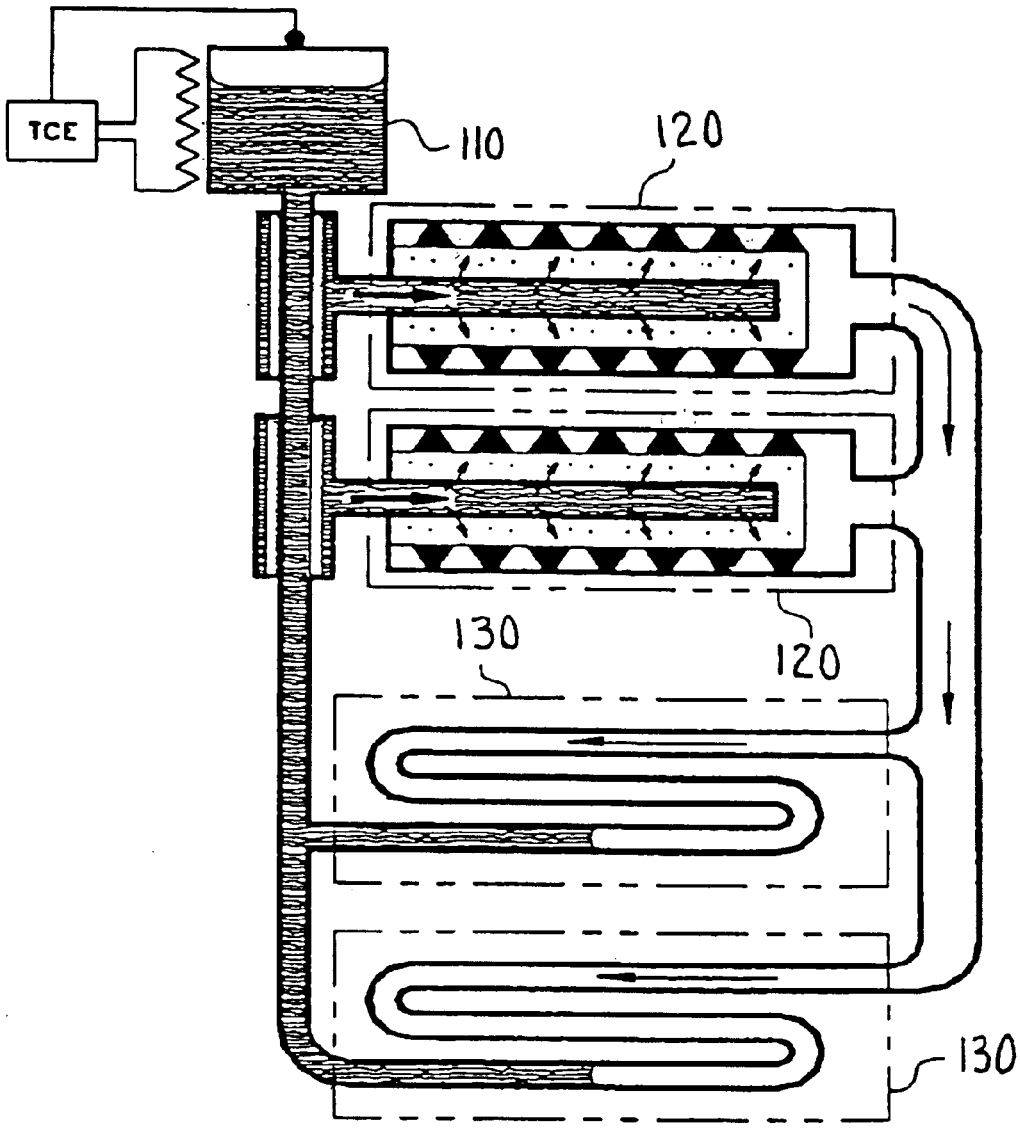
FIG. 1 BACKGROUND ART
FIG. 1 illustrates a schematic view a CPL.
Figure 2:
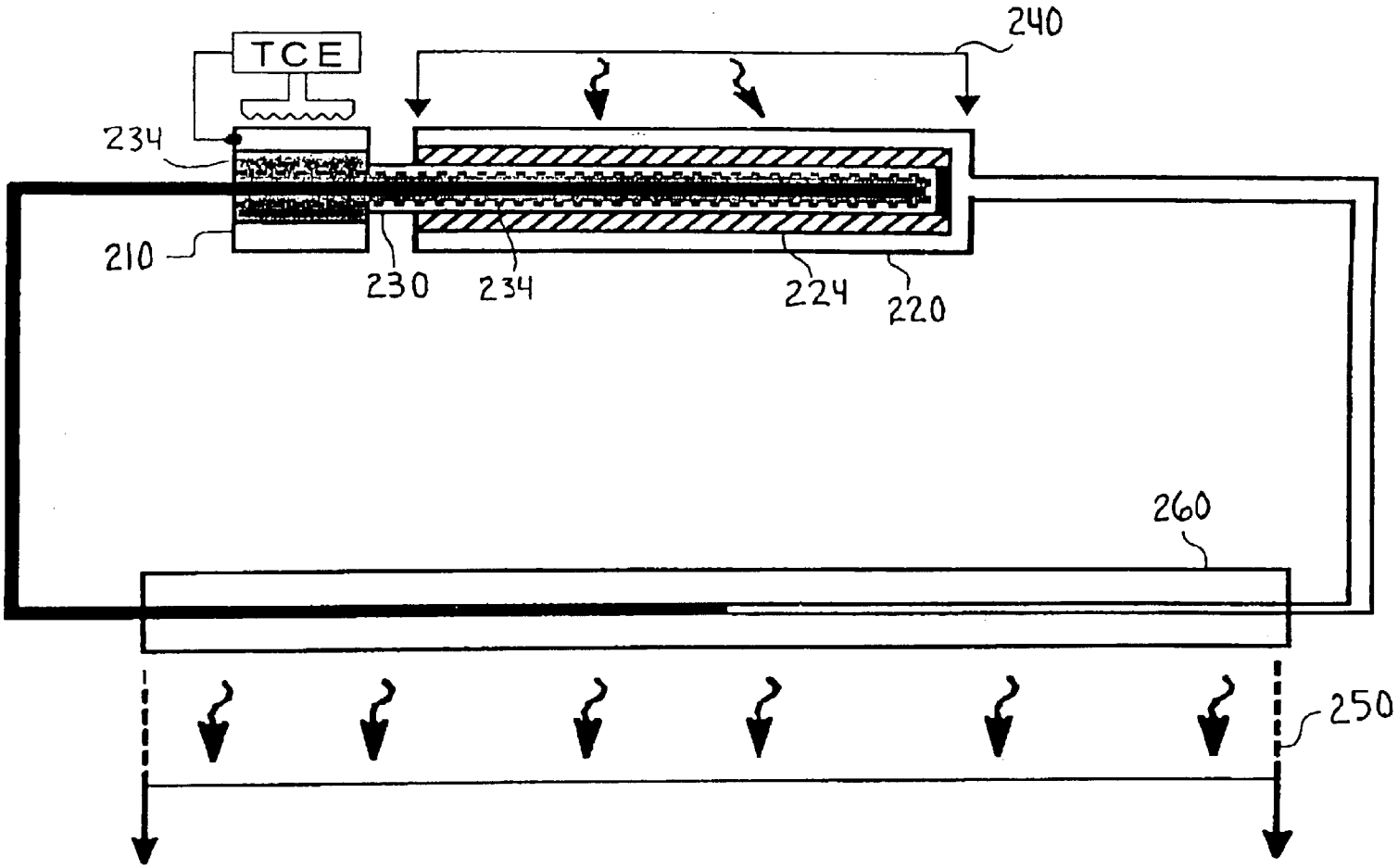
FIG. 2 BACKGROUND ART
FIG. 2 illustrates a schematic view a LHP.
Figure 3:
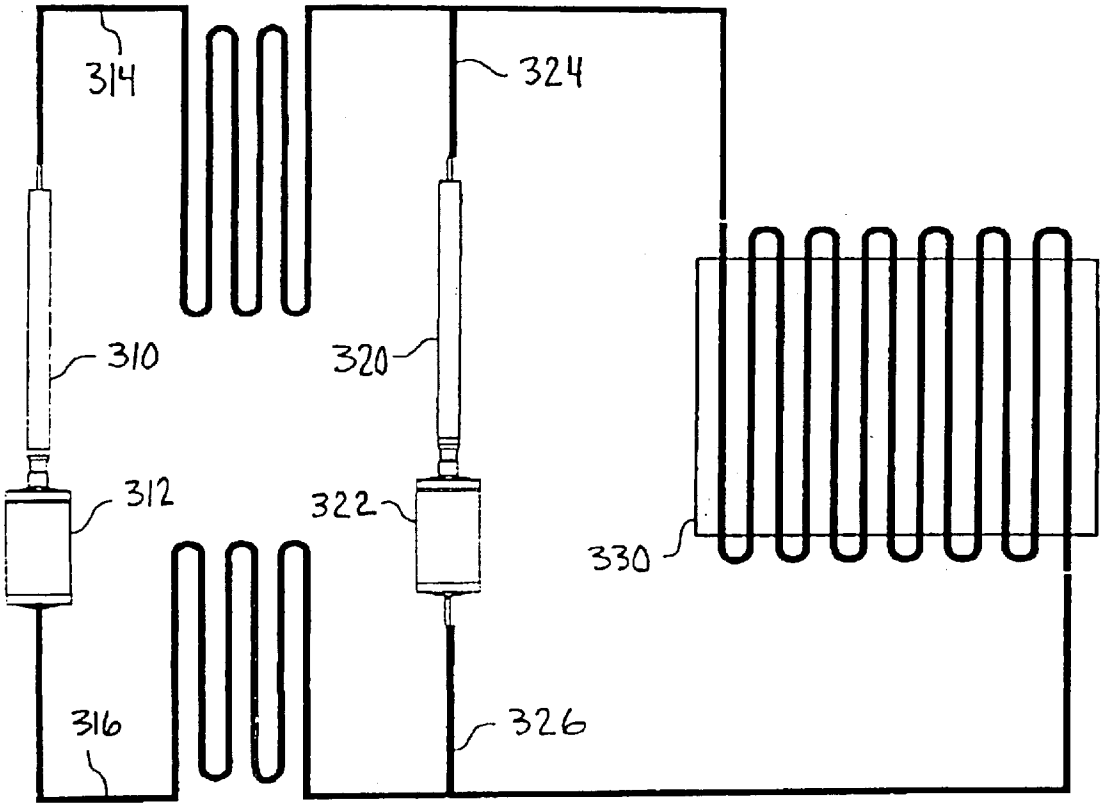
Figure 3 BACKGROUND ART
FIG. 3 illustrates a schematic view of a dual evaporator LHP.
Figure 4:
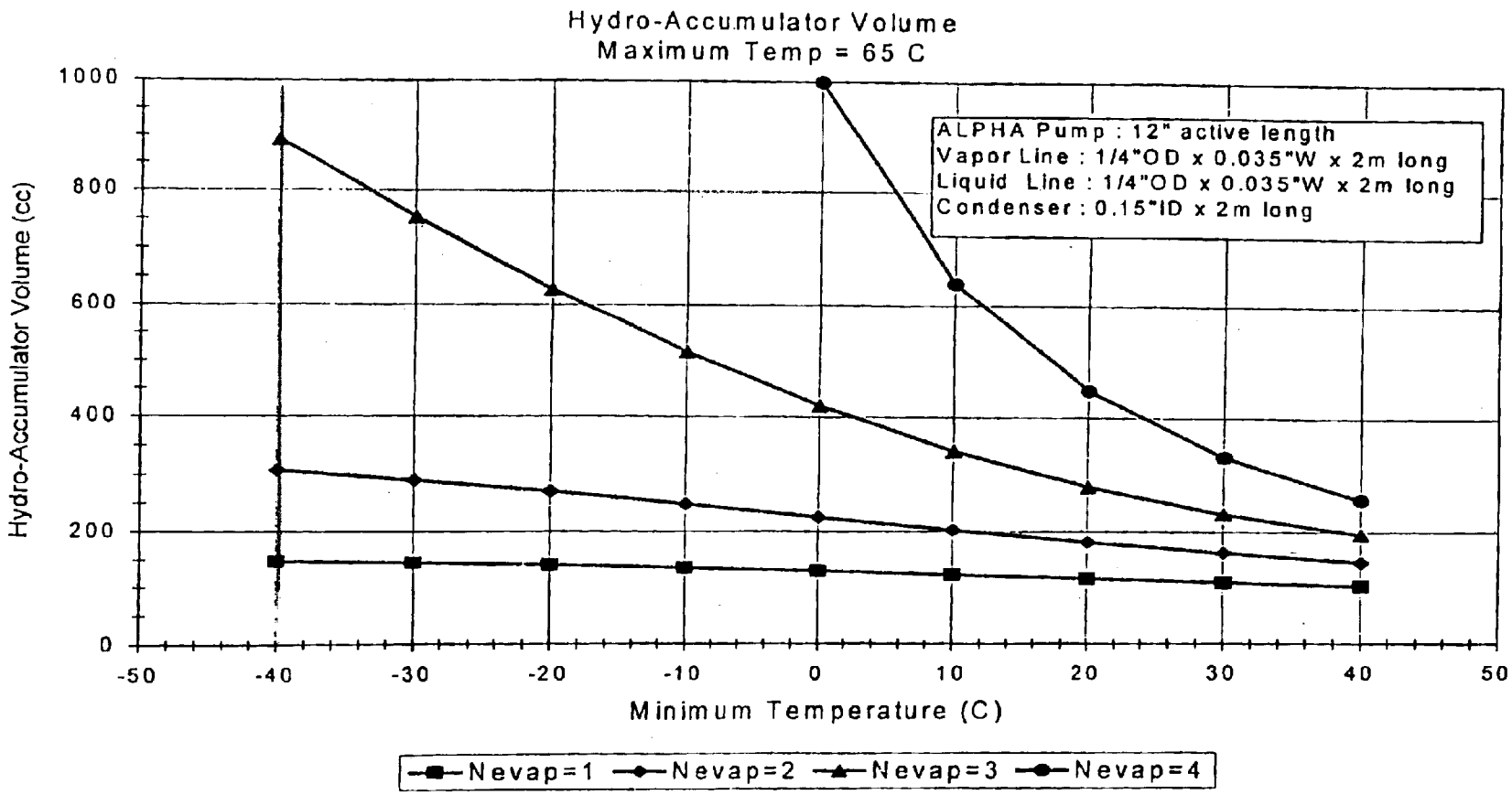
FIG. 4 BACKGROUND ART
FIG. 4 illustrates with a graph an analysis of hydro-accumulator sizing in a multiple evaporator LHP.
Figure 5:
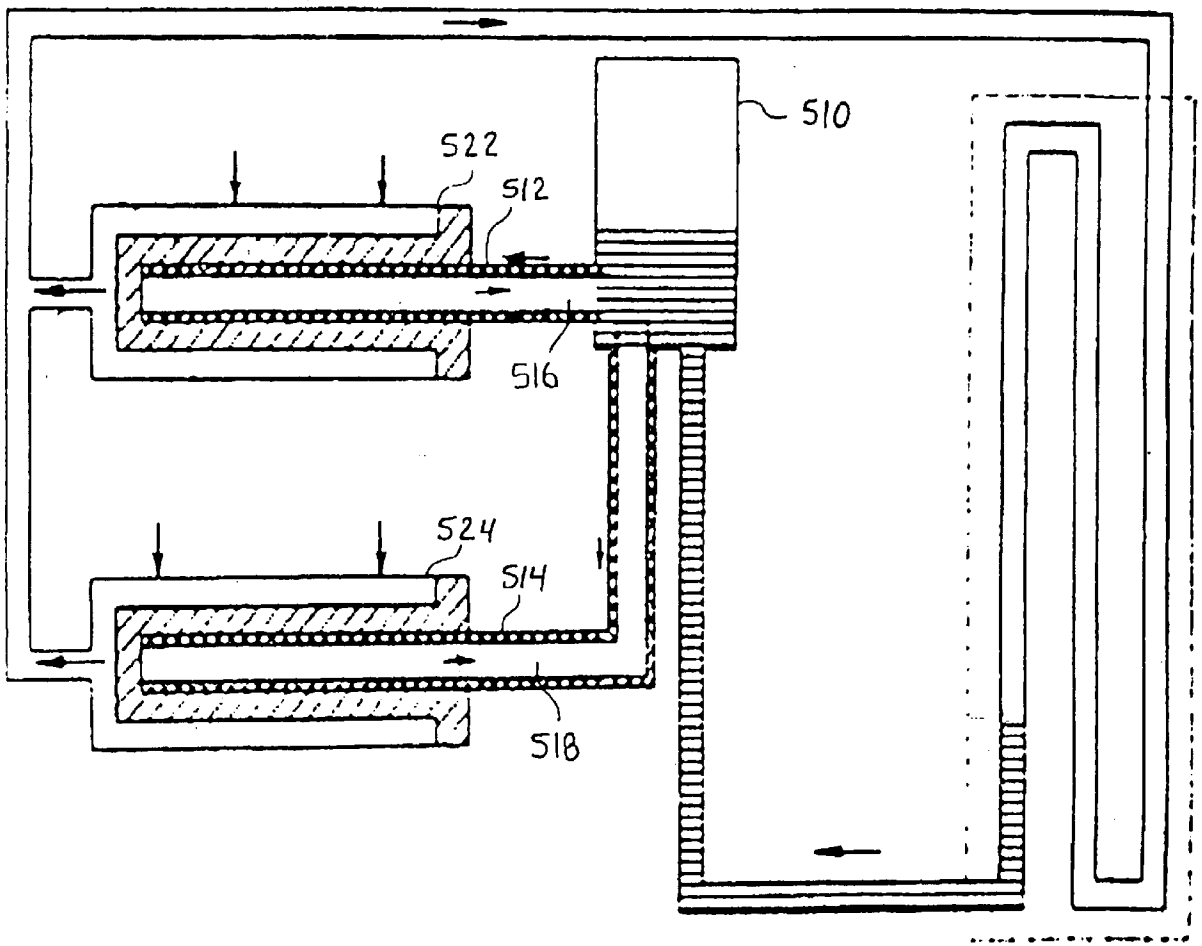
FIG. 5 BACKGROUND ART
FIG. 5 illustrates a schematic view of the basic design of a HPCPL loop.
Figure 6:
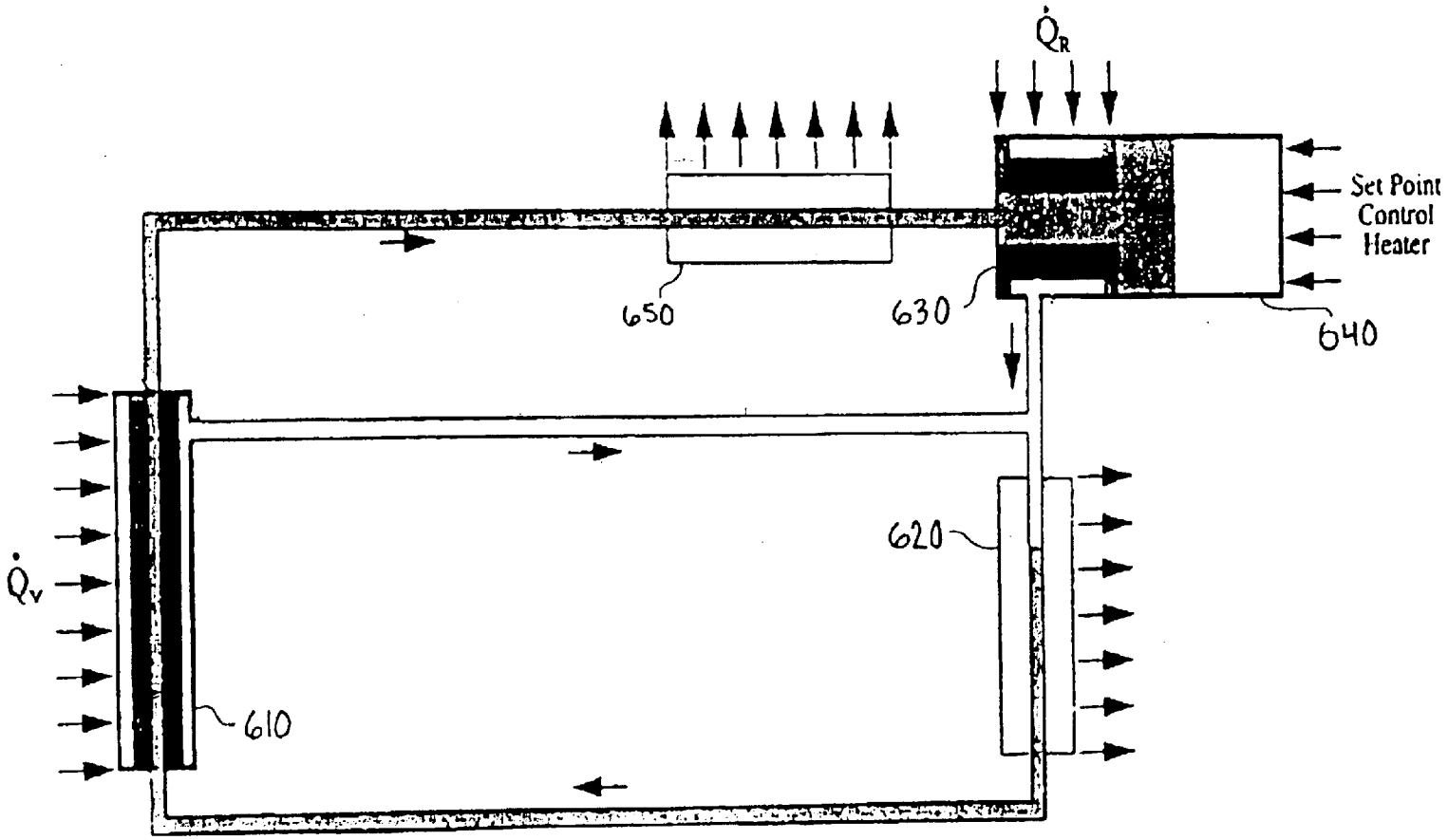
FIG. 6 BACKGROUND ART
FIG. 6 illustrates a schematic view of a A-CPL concept.
Figure 7:
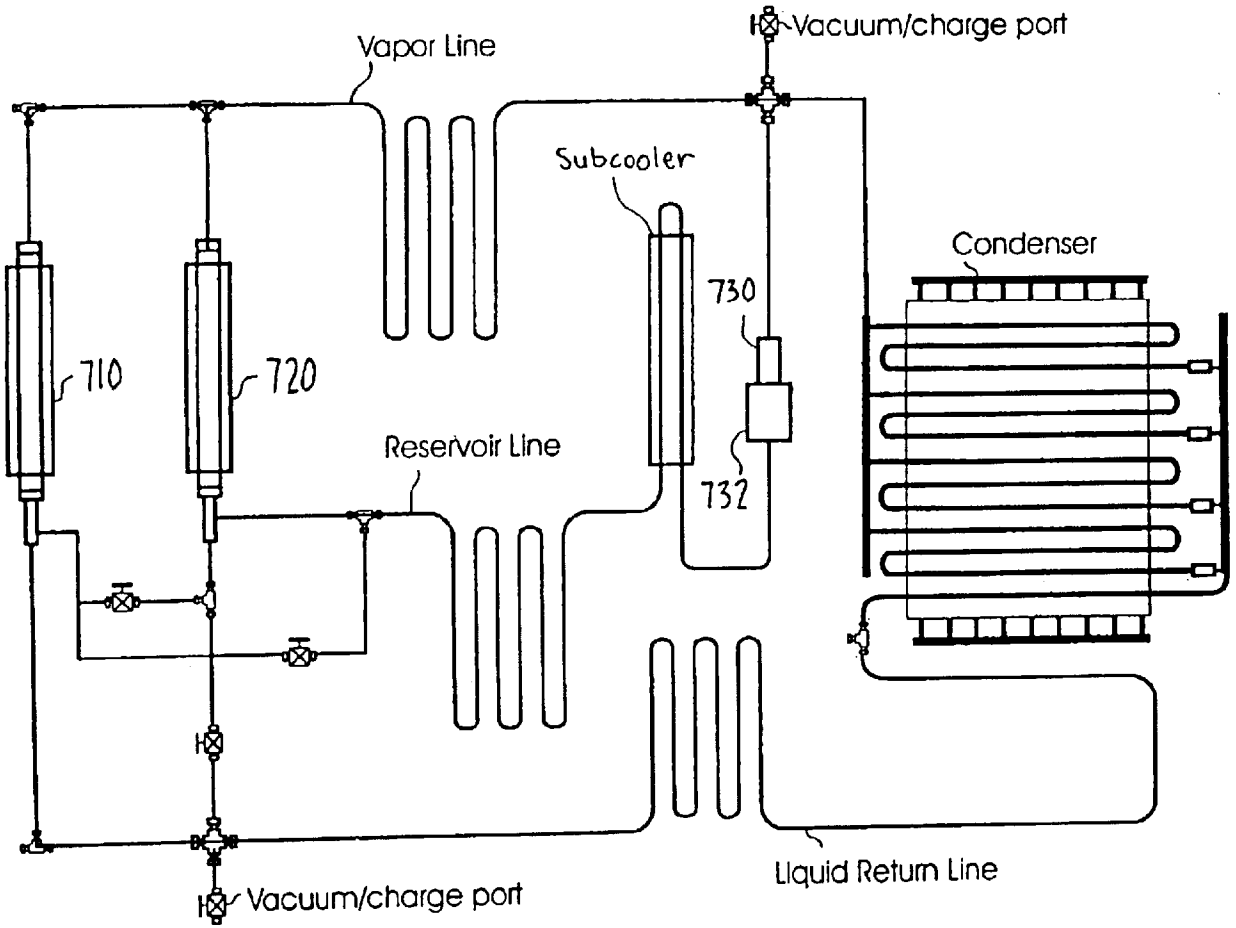
FIG. 7 BACKGROUND ART
FIG. 7 illustrates a schematic view of a A-CPL prototype.
Figure 8:
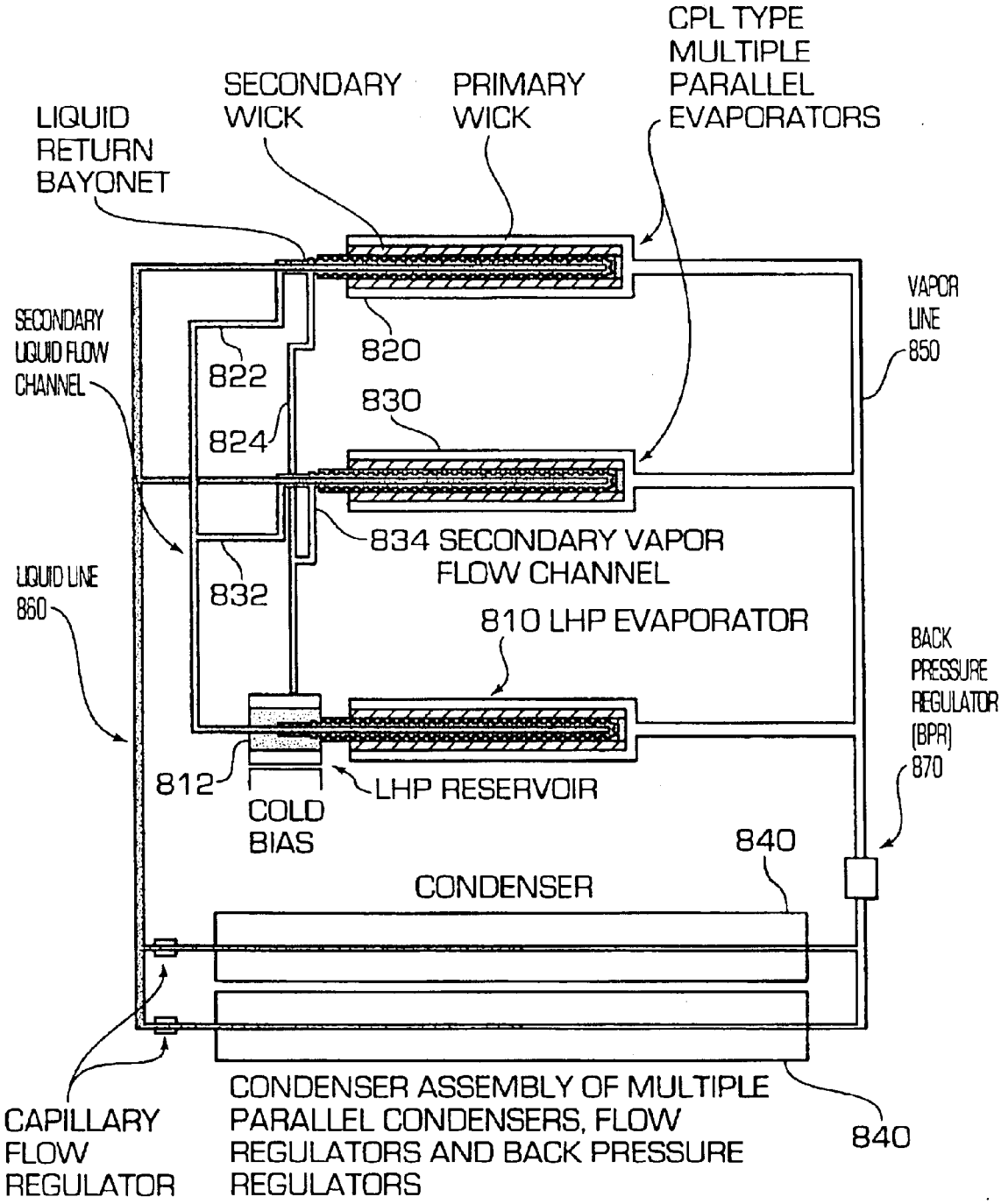
FIG. 8 illustrates a schematic view of a Hybrid CPL heat transport system according to an exemplary embodiment of the present invention.

Referring to FIG. 8, a schematic view of a Hybrid Capillary Pump Loop (HCPL) heat transport system according to an exemplary embodiment of the present invention is illustrated. The secondary loop consists of an LHP evaporator/reservoir assembly 810 that is plumbed in parallel with multiple modified CPL-type evaporators 820, 830 that are plumbed in parallel with one another. Fluid returning from the condensers 840 in the primary loop enters the liquid core of each modified CPL-type evaporators 820, 830 via a bayonet. In the core of each to the modified CPL-type evaporators 820, 830 the returned fluid is handled so that any liquid phase fluid is separated from any vapor or NCG bubbles that may be generated during the operation of the HCPL and have found their way into the core.

Most of the liquid in the cores of each of the modified CPL-type evaporators 820, 830 is pumped out through the primary wick. The balance of the liquid in each CPL evaporator core is coupled out via a secondary liquid flow channel 822, 832 that has been connected in parallel to the liquid return supply of the LHP evaporator/reservoir assembly 810. The vapor/NCG bubble portion that is separated out in the CPL evaporator core is coupled out via a secondary vapor flow channel 824, 834 that has been connected in parallel to entering the void volume (vapor space) of the LHP reservoir 812 of the LHP evaporator/reservoir assembly 810.

Thus, a secondary loop is formed by of an LHP evaporator/reservoir assembly 810 and multiple parallel secondary wick flow channels 822, 832, 824, 834 in each modified CPL-type evaporator 820, 830. The secondary (LHP) loop shares a common primary vapor line 850 with the primary loop and also shares the liquid return 860 of the primary loop via the parallel connections described above.

Figure 9:
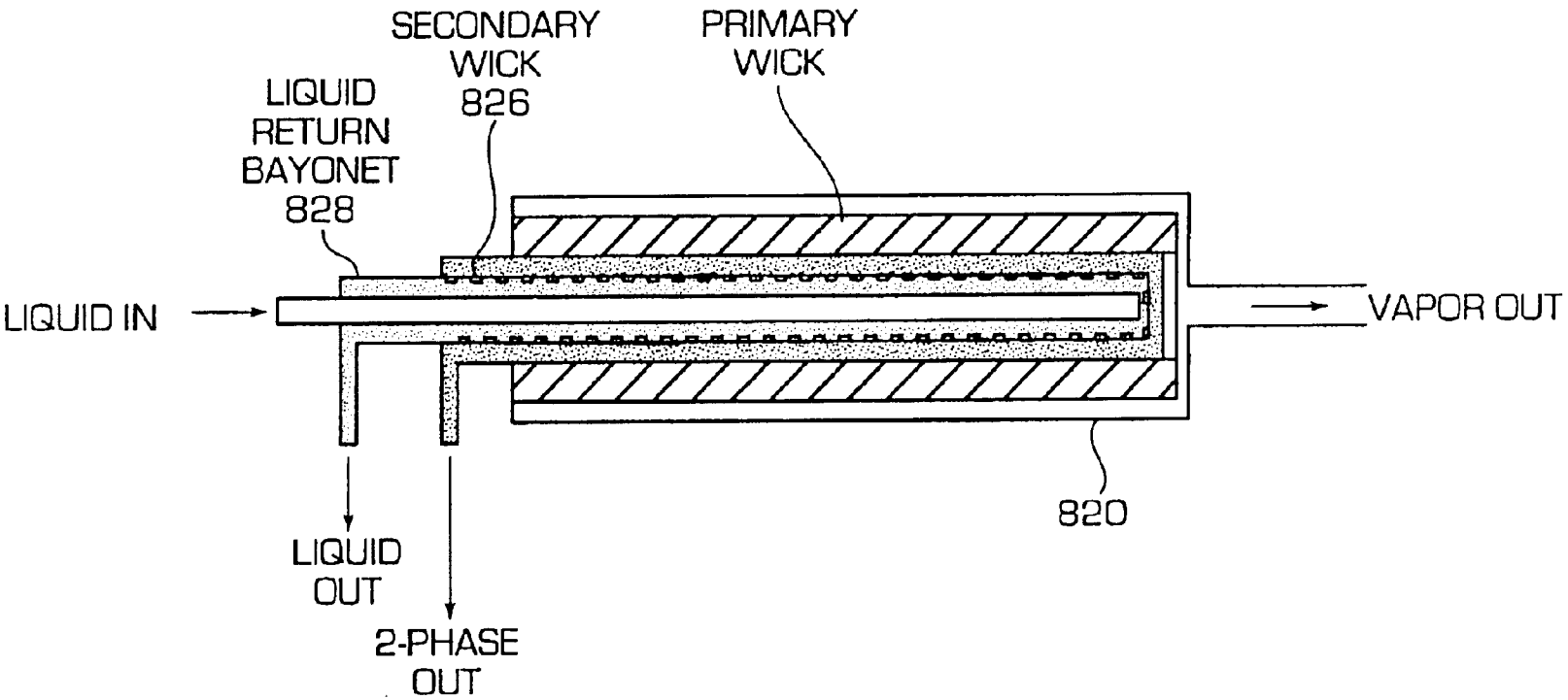
FIG. 9 illustrates a schematic view of an evaporator for use in a Hybrid CPL heat transport system according to an exemplary embodiment of the present invention.

Referring to FIG. 9, a schematic view of an evaporator for use in a HCPL heat transport system of FIG. 8 is illustrated. The core of the modified CPL-type evaporator 820 incorporates a secondary wick 826. Liquid returning from the condensers 840 in the primary loop enters modified CPL-type evaporator 820 core via a bayonet 828. The secondary wick 826 separates the liquid phase in the evaporator core from any vapor or NCG bubbles that may be generated during the operation of the HCPL.

The secondary loop provides the HCPL with robust and reliable LHP type performance characteristics during start-up, steady state operation, and heat sink/heat source temperature and power cycling.

I. Start-Up

Quick and reliable start-up is achieved by insuring appropriate liquid/vapor distribution. This is accomplished by simply applying heat to the LHP evaporator prior to initiating primary loop operation. Since the LHP evaporator is intimately connected to its reservoir that insures that the primary wick of the LHP evaporator is always wetted with liquid. Thus, reliable start-up of the secondary loop is always guaranteed. Once the secondary loop has been started, favorable conditions are created in the remainder of the HCPL loop that guarantees reliable primary loop start-up. Preconditioning requirements are minimal since only the clearing of the vapor header of any liquid is required to achieve reliable start-up.

Figure 10:
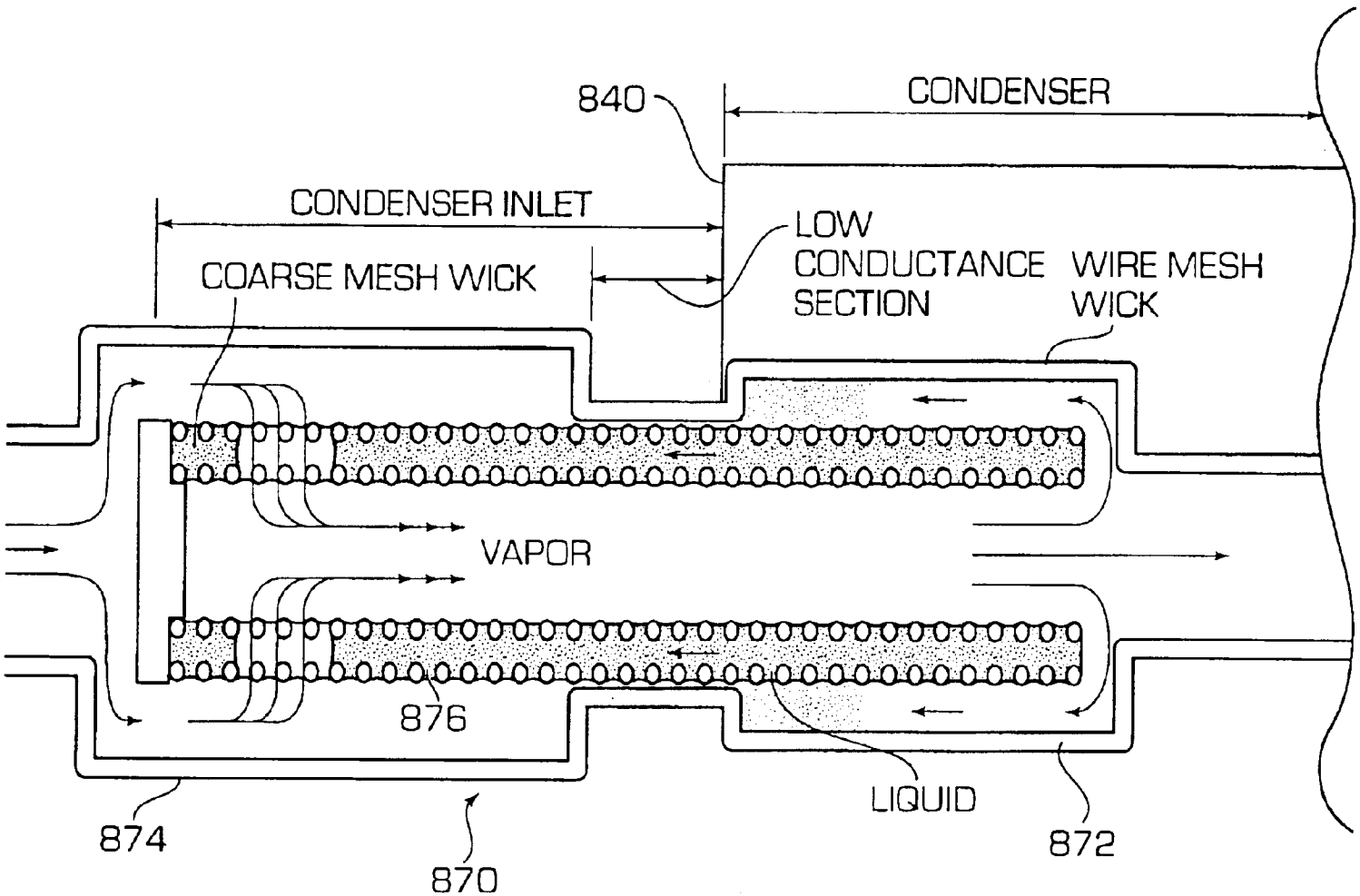
FIG. 10 illustrates a schematic view of a back pressure regulator for use in a Hybrid CPL heat transport system according to an exemplary embodiment of the present invention.

The ability to achieve quick reliable start-up of the HCPL is enhanced by the Back Pressure Regulator (BPR) 870 located at the inlet of the condenser 840. Referring to FIG. 10, a schematic view of a BPR 870 according to the present invention is illustrated. The BPR 870 contains a wick structure 876 located within a fitting. One end 872 of the fitting extends into the condenser region where it is exposed to the heat sink. The other end 874 of the fitting extends into the vapor header section and is isolated from the heat sink. Prior to start-up, the wick structure 876 is saturated with liquid due to the exposure of one end 872 of the fitting to the heat sink. During start-up, the capillary action of the wick structure 876 prevents any vapor from flowing to the condenser thus insuring that all of the vapor channels in the primary loop are cleared of liquid before flow is initiated into the condenser. This guarantees a quick and reliable start-up.

Once start-up has been achieved, a pressure head is developed in the vapor passages that exceeds the capillary back pressure of the BPR. At this point, vapor can flow into the condenser and heat can be rejected to ambient. Vapor flow to the condenser will continue as long as sufficient heat is applied to the evaporators. However, if the heat is reduced below that which is required to maintain the evaporator at a given temperature (i.e. as the vapor flow to the condenser drops below a certain value) capillary action of the BPR wick will prevent any further vapor flow to the condenser. Thus, the BPR, in addition to aiding start-up, provides a means of achieving near 100% heat load sharing between evaporators.

II. NCG and Vapor Bubble Management

Management of NCG and/or vapor bubbles in the core of capillary pumped looped evaporators is important for the reliable operation of any two-phase loop. Management of vapor bubbles is especially critical since heat conducted across the wick will either create new vapor bubbles and/or provide the energy required to expand any preexisting bubbles. Once a bubble becomes sufficiently large, liquid flow blockage in the evaporator core will result in primary wick deprime. Conventional LHPs are not susceptible to this kind of failure because the proximity of the reservoir allows venting of NCG/vapor bubbles from the evaporator core to the reservoir. Vented non-condensible gases (NCG) are stored in the reservoir void volume whereas, vapor bubbles are condensed, releasing the energy absorbed in the evaporator core due to the heat conduction across the primary wick. The condensate is returned to the evaporator core via a secondary wick.

In the HCPL the NCG/vapor bubble purging function is provided by the LHP Secondary Loop. Unlike prior attempts at connecting multiple evaporators to a central reservoir with individual secondary wicks (for example, the HPCPL arrangement proposed by Van Oost et al.), the secondary wicks in the HCPL are localized in each evaporator. The connection between each evaporator to the central reservoir is embodied as a plain smooth walled tubing devoid of any wick structure. Evaporators are connected in parallel thus allowing any number of evaporators to be interconnected irrespective of spatial separation.

Two steady state modes of operation are possible with the HCPL.

If a continuous heat load greater than or equal to the sum total heat conducted across all of the evaporator's secondary wicks is applied to the LHP evaporator, all liquid flowing to the evaporators will be supplied by the primary loop liquid line. Flow distribution between evaporators is controlled by the individual evaporator primary wicks which automatically adjust evaporator capillary pumping based on the heat load applied to the evaporator and by the individual evaporator secondary wicks which adjust evaporator core capillary pumping based on the heat conducted across individual wicks.

On the other hand, if no heat is applied to the LHP evaporator, only the liquid required to satisfy the pumping of the primary wick is provided by the primary loop liquid return. Vapor produced by the heat conducted through the evaporator wicks is condensed in the LHP reservoir and pumped back to the individual evaporator core by the secondary wicks.

In either case, flow distribution in HCPL loop is automatically and internally controlled by the capillary action of the primary and secondary wicks. This means that liquid flow distribution is regulated by capillary action that adjusts itself automatically based on flow requirement and local pressure drops.

III. Transient Mode Fluid Management

Failures of most two-phase loops occur during transient modes of operation that require the shuttling between the reservoir and the condenser. This shuttling is required to either open or shut down the condenser in response to sink temperature and/or input power transients. Liquid movement out of the reservoir must be accompanied by vapor expansion in the reservoir. One undesirable effect of fluid shuttling can result if uncontrolled vapor expansion occurs in the evaporator core instead of the reservoir. However, vapor bubble expansion is more likely to occur in the evaporator core than the reservoir due to the availability of energy from heat being applied to the evaporator.

Uncontrolled expansion of a vapor bubble in an evaporator core can block liquid flow to the primary wick, followed by primary wick liquid starvation and ultimately leading to failure if the primary wick deprimes. The secondary wick is designed to regulate vapor bubble expansion in the core via the capillary action of the secondary wick which guarantees liquid access to the priming wick. Preferential displacement of liquid from the reservoir occurs since there is no restriction of vapor bubble expansion due to capillary action.

The present invention has been described in terms of preferred embodiments, however, it will be appreciated that various modifications and improvements may be made to the described embodiments without departing from the scope of the invention.

What is claimed is:

1. A heat transport system comprising:

a condenser bank comprising one or more condensers;

a primary evaporator comprising a primary liquid port, a secondary fluid port, and a primary vapor port;

a liquid return line coupled to the primary liquid port and connecting the primary evaporator to the condenser bank;

a secondary fluid line coupled to the secondary fluid port of the primary evaporator;

a fluid reservoir in fluid communication with the secondary fluid line;

an auxiliary evaporator disposed adjacent the fluid reservoir, the auxiliary evaporator comprising:

a vapor output port;

a fluid port in fluid communication with the fluid reservoir; and a vapor line connecting the condenser bank to the vapor output port of the auxiliary evaporator and to the primary vapor port of the primary evaporator.

2. The heat transport system of 1, further comprising a back pressure regulator disposed in the vapor line to prevent migration of vapor into the condenser bank.

3. The heat transport system of claim 1, further comprising a capillary flow regulator connected to a liquid output line of a condenser of the condenser bank.

4. The heat transport system of claim 1, wherein the primary wick includes a core, the primary liquid port feeds into the core through a liquid bayonet, the secondary wick provides a flow path between the secondary liquid port and the core, the primary vapor port is coupled to receive vapor exiting the primary wick, and the secondary vapor port is coupled to the core.

5. An evaporator system for use in a heat transport system, the evaporator system comprising:

an evaporator including:

a primary wick defining a core;

a vapor channel configured to receive vapor exiting the primary wick;

a liquid channel within the core that is configured to receive liquid;

a secondary wick within the core providing a flow path within the the core;

a secondary liquid channel within the secondary wick; and a two phase channel between the secondary wick and the primary wick;

a first port coupled to the secondary liquid channel of the evaporator; and a second port coupled to the two phase channel of the evaporator.

6. The evaporator system of claim 5 wherein the secondary wick is configured to separate liquid and vapor within the core.

7. The heat transport system of claim 1 wherein the secondary fluid port is not in fluid communication with the primary liquid port.

8. The heat transport system of claim 1 further comprising:

a second primary evaporator, and a second secondary fluid line coupled to the secondary fluid port of the second primary evaporator, wherein the liquid return line is coupled to the primary liquid port of the second primary evaporator to connect the second primary evaporator to the condenser bank and the vapor line connects the condenser bank to the vapor output port of the auxiliary evaporator and to the primary vapor port of the second primary evaporator.

9. The heat transport system of claim 8 wherein the second primary evaporator is connected in parallel with the primary evaporator relative to the condenser bank.

10. A heat transport system comprising:

a primary loop including:

a primary evaporator including primary wick defining a core and a vapor channel, and a condenser coupled with the primary evaporator by a liquid line in fluid communication with the core and a vapor line in fluid communication with the vapor channel; and a secondary loop configured to purge at least one of vapor and non-condensable gas bubbles from the core of the primary evaporator, the secondary loop including:

a secondary fluid line in fluid communication with the primary evaporator, a secondary evaporator coupled with the condenser through the vapor line, and a reservoir in fluid communication with the secondary evaporator and coupled to the primary evaporator by the secondary fluid line.

11. The heat transport system of claim 10 wherein the reservoir is cold biased.

12. The heat transport system of claim 10 wherein primary evaporator includes a bayonet that couples fluid from the fluid line to the core.

13. The heat transport system of claim 10 wherein the primary evaporator includes a secondary wick within the core that separates at least one of vapor and non-condensable gas bubbles from liquid in the core.

14. The heat transport system of claim 13 wherein the secondary fluid line provides a flow path for at least one of vapor and non-condensible gas bubbles from the core of the primary evaporator to the reservoir.

15. The heat transport system of claim 13 wherein the secondary wick is configured to permit adjustment of capillary pumping within the core of the primary evaporator based on heat conducted across the secondary wick.

16. The heat transport system of claim 10 wherein the secondary fluid line is segregated from the liquid line.

17. The heat transport system of claim 10 wherein the primary evaporator includes:

a primary liquid port in fluid communication with the liquid line, a primary vapor port in fluid communication with the vapor line, and a fluid port in fluid communication with the secondary fluid line.

18. The heat transport system of claim 17 wherein the primary evaporator includes a secondary liquid port in fluid communication with the reservoir.

19. The heat transport system of claim 17 wherein the fluid port is a secondary vapor port.

20. The heat transport system of claim 10 wherein the reservoir is coupled to the primary evaporator by a secondary liquid line.

21. The heat transport system of claim 10 wherein the primary loop includes a back pressure regulator in the vapor line.

22. The heat transport system of claim 21 wherein the back pressure regulator includes a wick structure coupled to the condenser.

23. The heat transport system of claim 21 wherein the back pressure regulator is configured to prevent vapor from flowing into the condenser until a pressure head is developed in the vapor line that exceeds a capillary back pressure in the wick structure.

24. The heat transport system of claim 10 further comprising a second primary loop including:

a primary evaporator including a primary wick defining a core and a vapor channel, a condenser coupled with the primary evaporator by a second liquid line in fluid communication with the core and a second vapor line in fluid communication with the vapor channel, the second liquid line at least partially overlapping with the liquid line and the second vapor line at least partially overlapping with the vapor line.

25. The heat transport system of claim 24 further comprising a back pressure regulator in the portion of the vapor line that overlaps with the second vapor line, the back pressure regulator configured to load share heat applied to the primary evaporators.

26. The heat transport system of claim 24 further comprising a second secondary loop configured to purge at least one of vapor and non-condensable gas bubbles from the core of the primary evaporator of the secondary primary loop, the second secondary loop including a second secondary fluid line coupling the primary evaporator of the second secondary loop with the reservoir.

27. The evaporator system of claim 5 wherein the vapor channel is outside of the core.

28. The evaporator system of claim 5 further comprising a third port coupled to the vapor channel.

29. The evaporator system of claim 28 further comprising a fourth port coupled to the liquid channel.

30. The evaporator system of claim 29 wherein the fourth port is coupled to the liquid channel by a bayonet.

31. The evaporator system of claim 5 wherein the liquid channel is configured to receive liquid from a source external to the evaporator.

32. A heat transport system comprising:

a means for condensing fluid;

a means for evaporating fluid including:
- a first means for receiving liquid, and
- a second means for receiving liquid, and
- a first means for outputting vapor;

a first means for fluidly connecting the evaporating fluid means to the condensing fluid means, the first connecting means being coupled to the first liquid receiving means;

a means for storing excess fluid in the heat transport system;

a second means for fluidly connecting the second liquid receiving means to the means for storing excess fluid;

an auxiliary means for evaporating fluid adjacent the means for storing excess fluid, the auxiliary means comprising:
- a second means for outputting vapor;
- a means for fluidly communicating with the means for storing excess fluid; and
- a means for fluidly connecting the condensing fluid means to the first outputting vapor means and to the second outputting vapor means.

33. An evaporator system for use in a heat transport system, the evaporator system comprising:

a means for evaporating fluid including:
- a primary means for wicking defining a core;
- a means for receiving vapor exiting the primary wicking means;
- a primary means for receiving liquid, the primary liquid receiving means within the core;
- a secondary means for wicking within the core providing a flow path within the core;
- a secondary means for receiving liquid, the secondary liquid receiving means within the secondary wicking means; and
- a means for receiving two phase fluid between the secondary wicking means and the primary wicking means;

a first port means for receiving liquid from the secondary liquid receiving means; and a second port means for receiving two phase fluid from the two phase fluid receiving means.

34. A heat transport system comprising:

a primary loop means including:
- a primary evaporating means including primary wick defining a core and a vapor channel, and
- a condensing means coupled with the primary evaporating means by a liquid line in fluid communication with the core and a vapor line in fluid communication with the vapor channel; and a secondary loop means for purging at least one of vapor and non-condensable gas bubbles from the core of the primary evaporating means, the secondary loop means including:
- a secondary fluid means for fluid communication with the primary evaporating means,
- a secondary evaporating means coupled with the condensing means through the vapor line, and
- a means for storing fluid, the means for storing fluid being in fluid communication with the secondary evaporating means and coupled to the primary evaporating means by the secondary fluid means.

* * * * *

UNITED STATES PATENT AND TRADEMARK OFFICE

CERTIFICATE OF CORRECTION

PATENT NO. : 6,889,754 B2
APPLICATION NO. : 09/896561
DATED : May 10, 2005
INVENTOR(S) : Edward J. Kroliczek, David A. Wolf, Sr. and James Seokgeun Yun It is certified that error appears in the above-identified patent and that said Letters Patent is hereby corrected as shown below:

Column 3
Line 13, delete “and”

Column 6
Line 5, replace “to” with --of--

Column 10
Claim 26, line 62, replace “secondary” with --second--

Signed and Sealed this

Twelfth Day of June, 2007

JON W. DUDAS
*Director of the United States Patent and Trademark Office*